United States Patent [19]

Nesslage et al.

[11] 4,059,437

[45] Nov. 22, 1977

[54] OXYGEN-FREE COPPER PRODUCT AND PROCESS

[75] Inventors: Donald John Nesslage, Old Bridge; Lin Sheng Yu, Princeton, both of N.J.; Michael Francis Shaw, El Paso, Tex.

[73] Assignee: Phelps Dodge Industries, Inc., New York, N.Y.

[21] Appl. No.: 592,622

[22] Filed: July 2, 1975

[51] Int. Cl.[2] ..... C22C 9/05; C22F 1/08

[52] U.S. Cl. ..... 75/76; 75/161; 148/11.5 C; 148/32

[58] Field of Search ..... 148/32, 11.5 C; 75/161, 75/76

[56] References Cited

U.S. PATENT DOCUMENTS

| | | | |
|---|---|---|---|
| 1,660,220 | 2/1928 | de Golyer | 75/76 |
| 2,003,296 | 6/1935 | Jennison et al. | 75/76 |
| 2,003,889 | 6/1935 | Jennison et al. | 75/76 |

FOREIGN PATENT DOCUMENTS

| | | | |
|---|---|---|---|
| 379,034 | 8/1932 | United Kingdom | 148/161 |

*Primary Examiner*—W. Stallard

*Attorney, Agent, or Firm*—Davis, Hoxie, Faithfull & Hapgood

[57] ABSTRACT

An improved copper product and process of making it, wherein oxygen-free copper contains small amounts of manganese above normal impurity levels, and has enhanced grain size control during annealing, high electrical conductivity, and increased ductility as cast or fabricated. By adding approximately 1 to approximately 100 parts per million of manganese, the desired oxygen-free product has a minimum electrical conductivity of 100% I.A.C.S. By adding approximately 1 to approximately 50 parts per million of manganese, the desired oxygen-free product has a minimum electrical conductivity of 101% I.A.C.S. When at least approximately 30 parts per million of manganese are added to the oxygen-free copper, ductility is maximized. The manganese may be added at any convenient stage of producing the oxygen-free copper. The copper after annealing is free of or less subject to roughened surfaces or cracking.

22 Claims, 13 Drawing Figures

HEAVY SULFUR SEGREGATION IN A CONVENTIONAL OXYGEN-FREE COPPER

TRACE SULFUR SEGREGATION IN OXYGEN-FREE COPPER CONTAINING 7 ppm MANGANESE

ROD Nº 1

300X

ROD Nº 3

300X

ROD Nº 4

300X

OXYGEN-FREE COPPER PRODUCT AND PROCESS

BACKGROUND OF THE INVENTION

The invention relates to oxygen-free copper, produced without the use of deoxidizers, rather than deoxidized copper. Conventional oxygen-free coppers are known to typically contain less than one part per million by weight of manganese as an impurity, and also contain other impurities. For example, the ASTM Standard Specification B 170-72 for Oxygen-Free Electrolytic Copper Wire Bars, Billets and Cakes provides for Grade 1 (minimum electrical conductivity of 101% I.A.C.S.) that the total impurities present be no more than 100 parts per million by weight, that the oxygen impurity present be no more than 10 parts per million by weight, that the sulphur impurity present be no more than 18 parts per million by weight, and that the total of all arsenic, antimony, bismuth, selenium, tellurium, tin and manganese impurities present be no more than 40 parts per million by weight. It is generally desirable to control and reduce impurities in oxygen-free copper.

It is well known in the art that to obtain desired properties in wrought oxygen-free copper, the metal should be properly worked and annealed. Also as known, annealing involves the process of recovery, recrystallization and grain growth, with the grain size of an annealed copper depending, among other things, on the time and temperature of the annealing operations and the nature and amount of cold working to which the metal has been subjected. Difficulties arise during such operations, however. After heating conventional oxygen-free coppers at temperatures from 750° to 1,400° F as in most commercial annealing operations, or at temperatures from 1,400° to 1,900° F as in brazing, a mixture of widely different grain sizes (i.e., an abnormal grain structure) usually develops, with larger grains often being of the order of ten times larger in diameter than the smaller grains. The art has considered such a grain structure to be highly undesirable, and the inventors here believe that it often leads to roughened, or "orange peel", surfaces of the copper. The abnormal grain structure further is thought by the inventors here to set up abnormal stresses during cold working or during use, and uneven flow during cold forming. A brittle form of cracking also occurs in oxygen-free copper even when the sulphur content is less than 18 parts per million by weight.

SUMMARY OF INVENTION

It has been found under the present invention that by adding to oxygen-free copper small amounts of manganese in addition to the manganese impurity level present, that the abnormal grain structure can be lessened or eliminated, and that consequently the roughened or "orange peel" surfaces and various forms of cracking and uneven flow during cold forming can be alleviated or eliminated.

Amounts of manganese added at any convenient stage during the production of the oxygen-free copper in the range of approximately 1 to approximately 100 parts per million by weight provide enhanced grain size control during annealing of the copper, a minimum electrical conductivity of 100% I.A.C.S., and increased ductility of the copper as cast or fabricated. Amounts of manganese added in the range of approximately 1 to approximately 50 parts per million by weight provide enhanced grain size control during annealing of the copper, a minimum electrical conductivity of 101% I.A.C.S., and increased ductility of the copper as cast or fabricated. When at least approximately 30 parts per million by weight of manganese are added, ductility is maximized. In each instance, the "orange peel" surfaces and various forms of cracking and uneven flow during cold forming are aleviated or eliminated.

Objects of the present invention accordingly include providing an improved oxygen-free copper with improved annealing characteristics, improved grain structure after heating at elevated temperatures, less or no surface roughening or cracking after light cold working and annealing, high conductivity, and increased ductility in cast or fabricated shapes.

DESCRIPTION OF DRAWINGS

FIG. 5(*b*) illustrates the degree of sulphur segregation in such oxygen-free copper with manganese added, as obtained by said probe;

DESCRIPTION OF EMBODIMENTS

The following examples and data are intended to further illustrate the nature of the present invention, but are not to be construed as limiting it thereto.

EXAMPLE I

A series of oxygen-free coppers, to which varying amounts of manganese were added, were continuously cast in the form of 4 inch by 4 inch wire bars. Analyses of the bars, numbered 1 through 8, are shown in Table 1.

Table 1

Chemical Analysis of Oxygen-Free Copper Containing Manganese

| | Bar Number | | | | | | | |
|---|---|---|---|---|---|---|---|---|
| Element | 1 | 2 | 3 | 4 | 5 | 6 | 7 | 8 |
| Sulfur,ppm | 7 | 10 | 12 | 9 | 10 | 10 | 10 | 9 |
| Oxygen | 5 | 3 | 5 | 2 | 1 | 1 | 3 | 3 |
| Arsenic | 1.4 | 1.3 | >1.0 | 1.3 | 1.3 | 1.3 | 1.4 | 1.5 |
| Tellurium | .82 | .7 | .7 | .5 | .7 | .7 | .7 | .7 |
| Antimony | 1.9 | 1.5 | .8 | .8 | 1.0 | .8 | 1.7 | 2.1 |
| Tin | >.5 | → | | | | | | |
| Bismuth | >.5 | → | | | | | | |
| Zinc | >.5 | → | | | | | | |
| Mercury | >.5 | → | | | | | | |
| Phosphorous | >.5 | → | | | | | | |
| Cadmium | >.5 | → | | | | | | |
| Nickel | 2.8 | 2.5 | 2.3 | 2.7 | 2.9 | 2.6 | 2.3 | 2.3 |
| Iron | 2.0 | 1.2 | 1.1 | 1.6 | 1.8 | 1.0 | 1.2 | 1.1 |

Table 1-continued

Chemical Analysis of Oxygen-Free Copper Containing Manganese

| Element | Bar Number 1 | 2 | 3 | 4 | 5 | 6 | 7 | 8 |
|---|---|---|---|---|---|---|---|---|
| Lead | <.5 | → | | | | | | |
| Manganese | <.5 | 1 | 12.2 | 23.7 | 30.8 | 39.8 | 58.7 | 76.3 |
| Silver,opt | .28 | .27 | .24 | .23 | .23 | .22 | .24 | .23 |

The bars were then hot rolled from a temperature of about 1625° F into 0.875 inch diameter rods. Samples were taken from the rods and the oxidized surface layers were milled off. The samples were then cold rolled to 0.192 inch thick flats, and cross-sectional specimens were cut from the flats and annealed in a preheated tube furnace under argon atmosphere at various temperatures ranging from 750° to 1850° F for different lengths of time ranging from 1 minute to 240 minutes.

Figure 1:
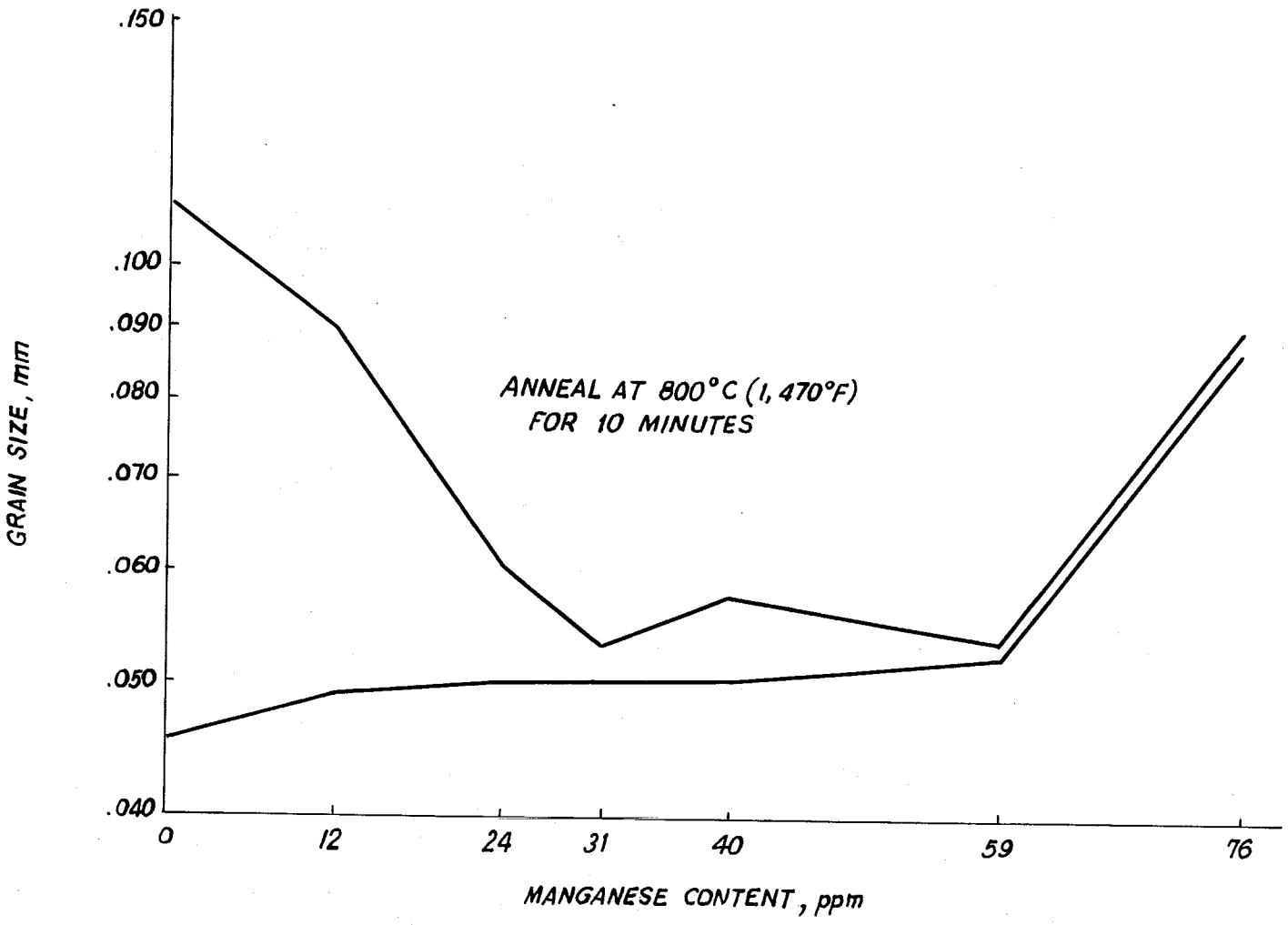
FIGS. 1 through 4 illustrate the difference between the largest and smallest grains in cold worked and annealed specimens of oxygen-free copper with various amounts of manganese added.
Figure 2:
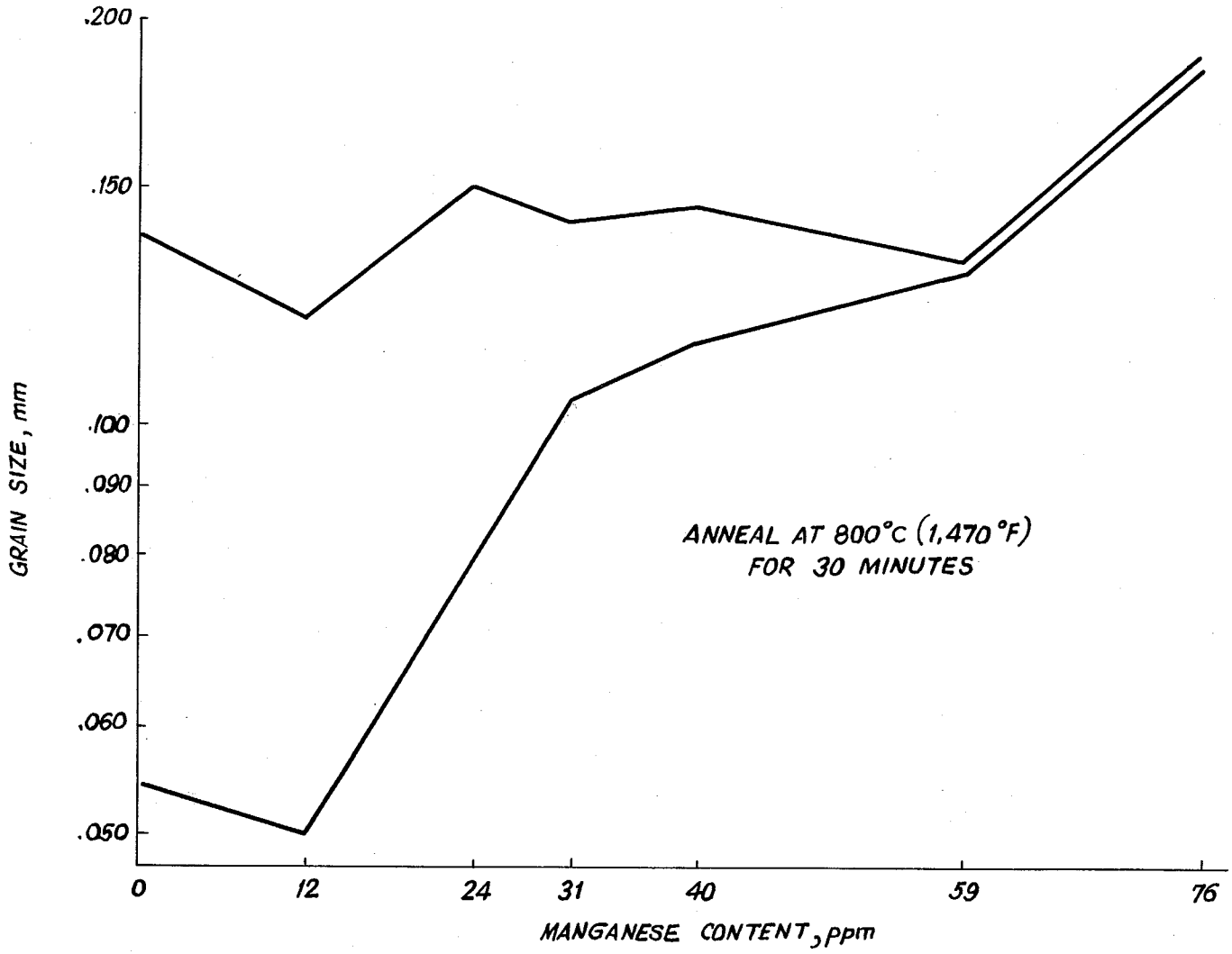
Figure 3:
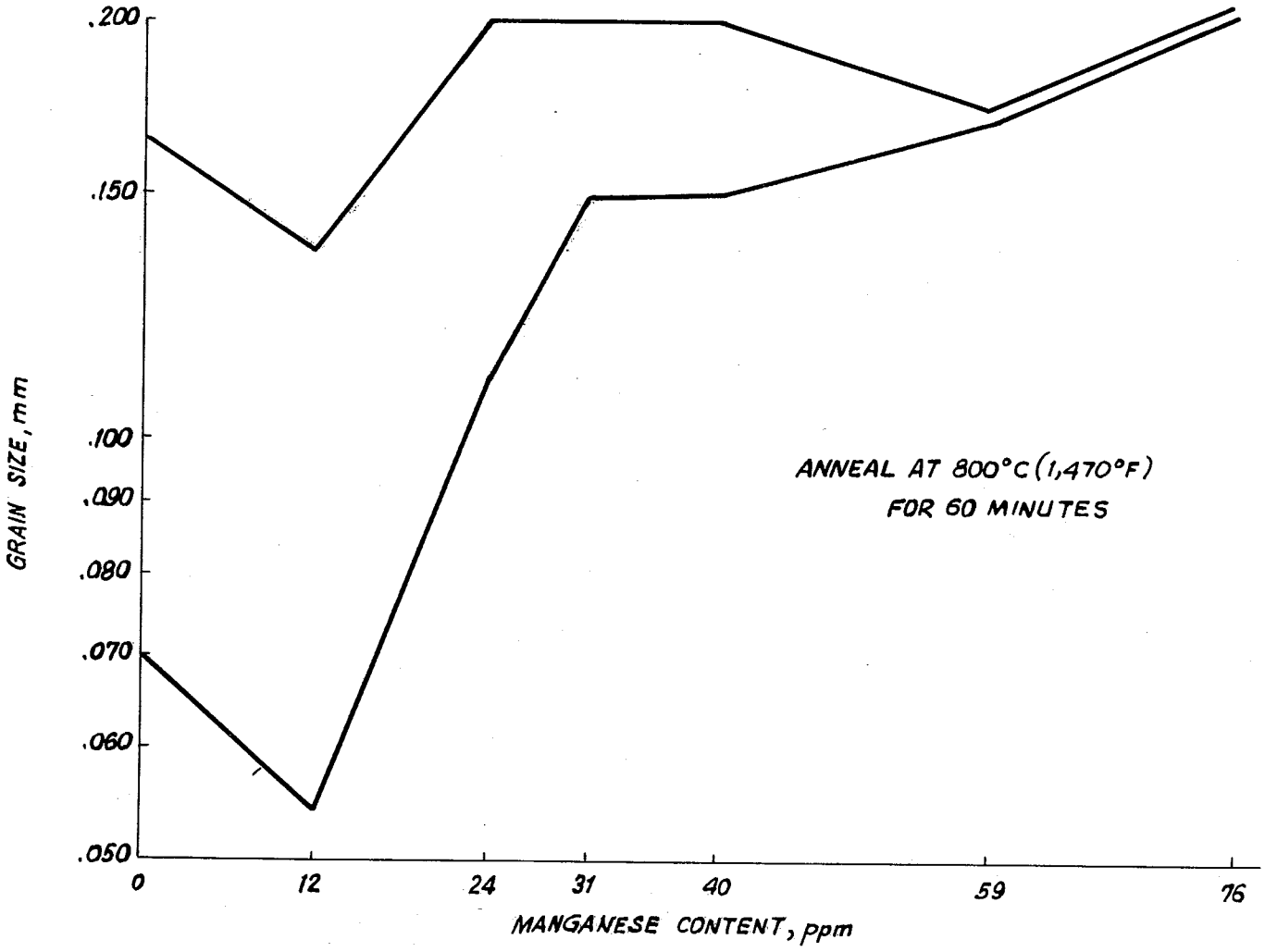
Figure 4:
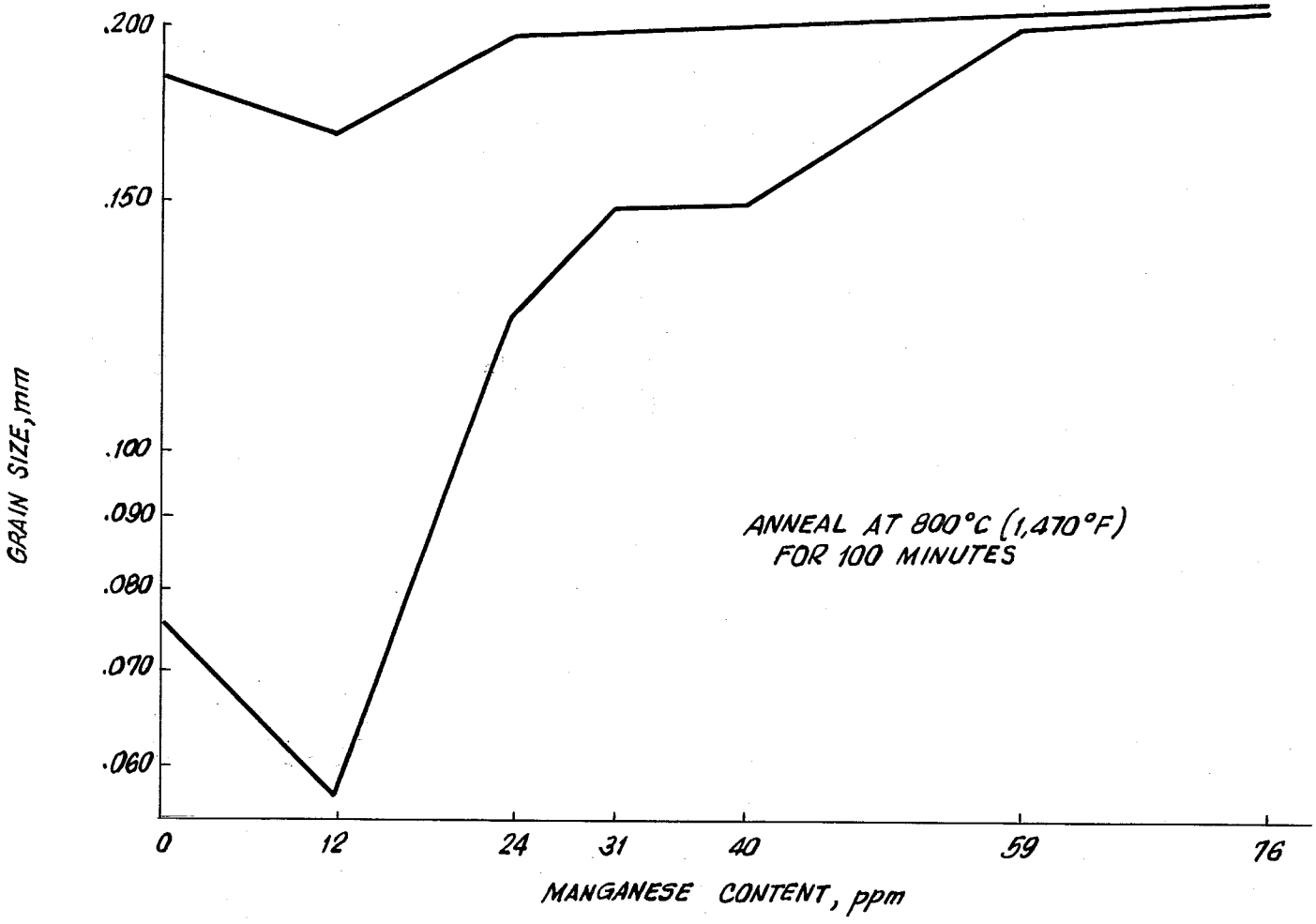

After annealing, the grain size and grain structure of the specimens were examined under the optical microscope. The high and low values of grain sizes were recorded for each annealing. It was apparent that the ranges in grain sizes within each of the specimens resulting from the thermal treatments were greatly reduced by the additions of manganese, and the amount of this reduction increased as the amount of manganese increased. FIGS. 1 through 4, for example, illustrate the difference in size between the largest grains (top line of each figure) and smallest grains (bottom line of each figure) in specimens from each of the eight original bars of Table 1 after annealing at 1470° F for 10 minutes (FIG. 1), 30 minutes (FIG. 2), 60 minutes (FIG. 3) and 100 minutes (FIG. 4). As can be seen, the increase in manganese amounted generally in reduction of ranges in grain size up to approximately 59 parts per million of manganese by weight.

EXAMPLE II

Hot rolled and shaved oxygen-free copper, and oxygen-free copper containing approximately 7 parts per million manganese by weight, were cold rolled from 0.525 inch diameter rods to 0.325 inch thick flats, and then annealed. After annealing, the coppers were cold drawn 15% reduction in area. The conventional oxygen-free copper developed brittle type cracks, while the copper containing manganese did not.

Figure 5A:
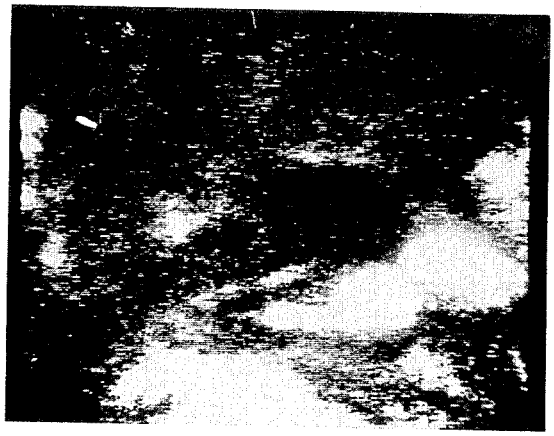
FIG. 5(*a*) illustrates the degree of sulphur segregation in cold worked and annealed oxygen-free copper, as obtained by a scanning Auger electron microprobe.
Figure 5B:
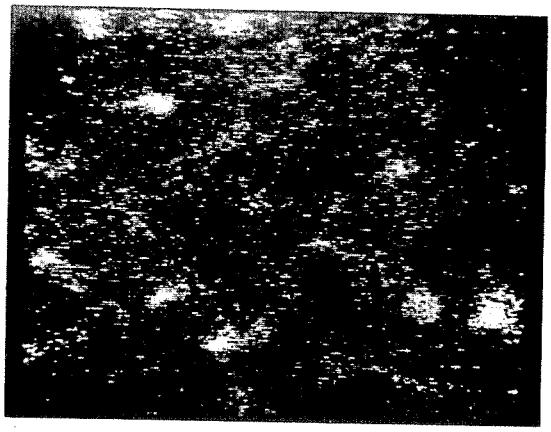

The two coppers were then fractured under high vacuum and the fracture surfaces were analyzed by a scanning Auger electron microprobe. FIG. 5(*a*) illustrates spots of high sulphur concentration on the fracture surface of the conventional oxygen-free copper, whereas FIG. 5(*b*) illustrates only traces of sulphur on the oxygen-free copper containing 7 parts per million manganese.

This example illustrates that manganese additions to oxygen-free copper improve its ductility by effectively reducing sulphur segregation.

EXAMPLE III

As a further example of the beneficial effects of manganese additions to oxygen-free copper, four small size rods, 0.735 inch in diameter, were continuously cast from a bath temperature of 2,200° F. The charges consisted of oxygen-free copper and electrolytic manganese. The copper charge was melted under charcoal cover and the first manganese added when the bath reached the desired temperature. Further manganese additions were made while temporarily stopping casting. Chemical analyses of the four rods are shown in Table 2, and illustrate that the impurity contents of the rods excluding manganese are within the specifications of ASTM B 170-72 and ASTM F68.

Table 2

Chemical Analysis of Continuously Cast 0.735 Inch Diameter Rods

| Element / Rod Number | Rod No.1 | Rod No.2 | Rod No.3 | Rod No.4 |
|---|---|---|---|---|
| Sulfur,ppm | 14 | 13 | 15.5 | 15 |
| Oxygen | 2.6 | 3.5 | 2 | 2.6 |
| Arsenic | 1.6 | 1.2 | 1.5 | 1.3 |
| Tellurium | 0.7 | 0.6 | 0.7 | 0.6 |
| Antimony | 0.6 | 0.5 | 0.6 | 0.6 |
| Tin | <0.5 | → | | |
| Bismuth | <0.5 | → | | |
| Zinc | <0.5 | → | | |
| Mercury | <0.5 | → | | |
| Phosphorous | <1.0 | → | | |
| Cadmium | <0.5 | → | | |
| Nickel | 3.3 | 3.1 | 3.0 | 3.3 |
| Iron | 3.6 | 4.5 | 4.7 | 7.0 |
| Lead | <1.0 | → | | |
| Manganese | 5 | 10.8 | 15.2 | 35 |
| Silver,opt | .26 | .22 | .26 | .24 |

The rods were then processed into 0.081 inch diameter wires and 0.103 inch flats. Tensile tests were made and the electrical conductivities of the rods were determined at various stages. The results are given in Tables 3 through 7 and FIGS. 6 through 8.

Table 3

Tensile Properties and Electrical Conductivities of Continuously Cast ¾ Inch Diameter Rods of PDOF/Mn - (As-Cast)

| Rod No. | UTS (psi) | YS(0.2% Ext.) (psi) | %Elong. in 2" | %Reduction In Area | Hardness $R_f$ | %IACS |
|---|---|---|---|---|---|---|
| 1 | 26,100 | 11,730 | 46 | 55 | 35 | 99.6 |
| 2 | 25,300 | 11,950 | 50 | 65 | 35 | 99.6 |
| 3 | 26,300 | 12,900 | 50 | 64 | 35 | 99.6 |
| 4 | 26,700 | 10,100 | 56 | 70 | 35 | 99.6 |

Table 4

Tensile Properties and Electrical Conductivities of Continuously Cast and Cold-Drawn 50% Rods

| Rod No. | UTS (psi) | YS(0.2%Ext.) (psi) | %Elong. in 2" | %Reduction In Area | Hardness $R_f$ | %IACS |
|---|---|---|---|---|---|---|
| 1 | 51,100 | 49,800 | 14 | 39.7 | 92 | 98.6 |
| 2 | 47,500 | 46,400 | 17 | 50.1 | 93 | 97.2 |

Table 4-continued

| Rod No. | UTS (psi) | YS(0.2%Ext.) (psi) | %Elong. in 2" | %Reduction In Area | Hardness $R_f$ | %IACS |
|---|---|---|---|---|---|---|
| | Tensile Properties and Electrical Conductivities of Continuously Cast and Cold-Drawn 50% Rods | | | | | |
| 3 | 48,500 | 48,500 | 18 | 52.8 | 92/93 | 98.6 |
| 4 | 50,200 | 49,700 | 18 | 63.2 | 92/93 | 96.8 |

Table 5

| Rod No. | UTS (psi) | YS(0.2%Ext.) (psi) | %Elong. in 2" | %Reduction In Area | Hardness $R_f$ | %IACS |
|---|---|---|---|---|---|---|
| | Tensile Properties and Electrical Conductivities of Continuously Cast Rods, Cold-Drawn 50% and Annealed (600° C for 50 min.) | | | | | |
| 1 | 21,300 | 5,590 | 33 | 21.6 | 28 | 101.3 |
| 2 | 27,900 | 6,140 | 33 | 31.8 | 30 | — |
| 3 | 29,100 | 6,300 | 36 | 33.8 | 33 | 101.2 |
| 4 | 31,100 | 6,590 | 59 | 70 | 29 | 101.1 |

Table 6

| Rod No. | UTS (psi) | YS(0.2%Ext.) (psi) | %Elong. in 2" | %Reduction In Area | Hardness $R_f$ | %IACS |
|---|---|---|---|---|---|---|
| | Tensile Properties and Electrical Conductivities of Continuously Cast Rods Cold Drawn 90% Reduction in Area | | | | | |
| 1 | 62,200 | 62,200 | 8 | 63 | 95 | 97.4 |
| 2 | 64,600 | 62,500 | 12 | 77 | 95 | 97.1 |
| 3 | 64,000 | 62,500 | 12 | 79 | 95 | 98.0 |
| 4 | 64,600 | 63,400 | 12 | 81 | 95 | 96.4 |

Table 7

| Rod No. | UTS (psi) | YS(0.2%Est.) (psi) | %Elong. in 2" | %Reduction in Area | Hardness $R_f$ | %IACS |
|---|---|---|---|---|---|---|
| | Tensile Properties and Electrical Conductivities of Continuously Cast Rods Cold Drawn 90% and Annealed at 600° C for 50 Minutes | | | | | |
| 1 | 24,800 | 8,610 | 53 | 68 | 30 | 101.8 |
| 2 | 34,800 | 9,580 | 61 | 86 | 38 | 101.6 |
| 3 | 34,900 | 8,980 | 59 | 88 | 24 | 101.6 |
| 4 | 34,800 | 8,980 | 58 | 88 | 31 | 101.2 |

Figure 7:
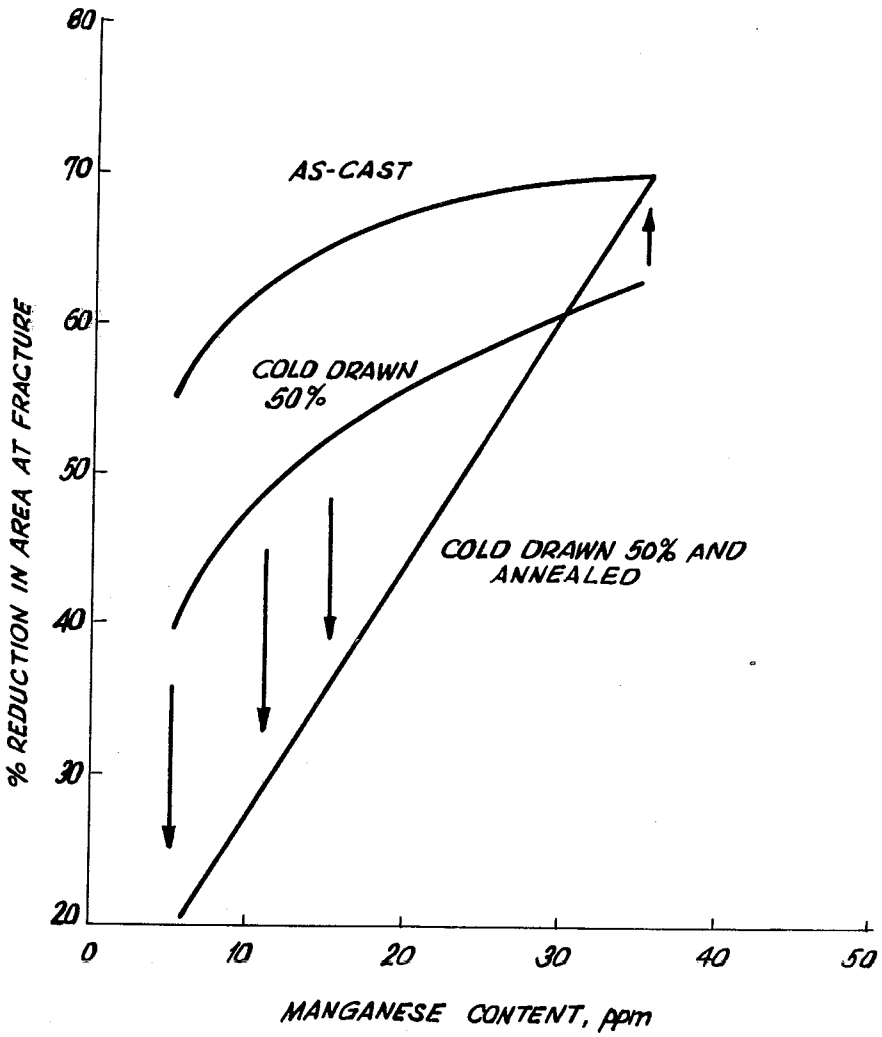
FIGS. 6–8 illustrate the fracture ductilities of oxygen-free copper with various amounts of manganese added.
Figure 6:
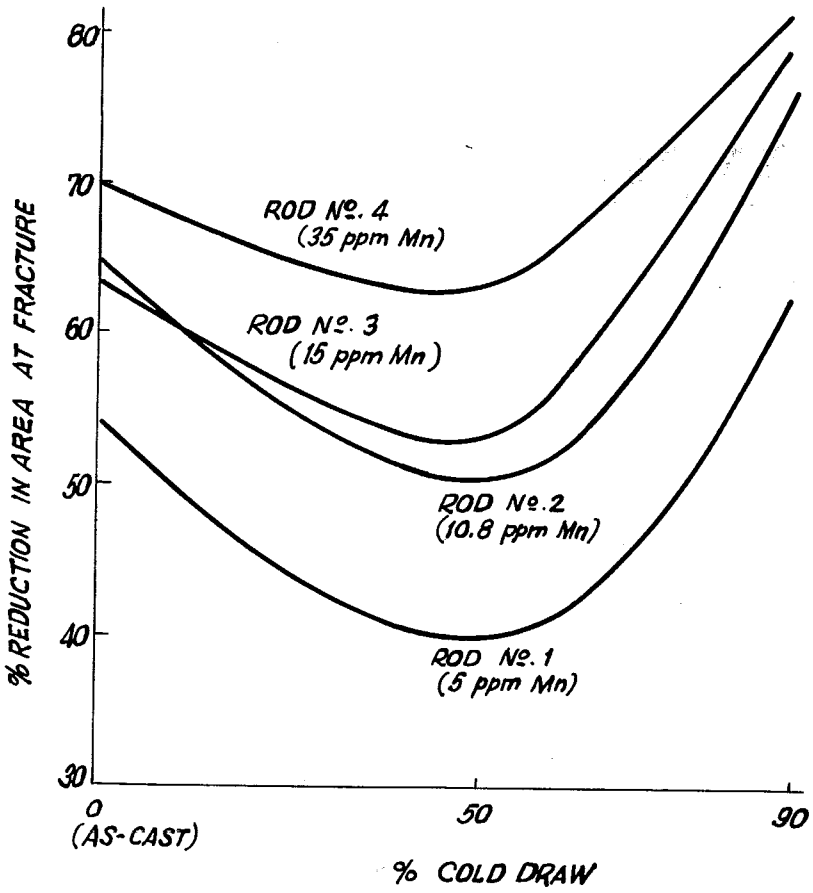
Figure 8:
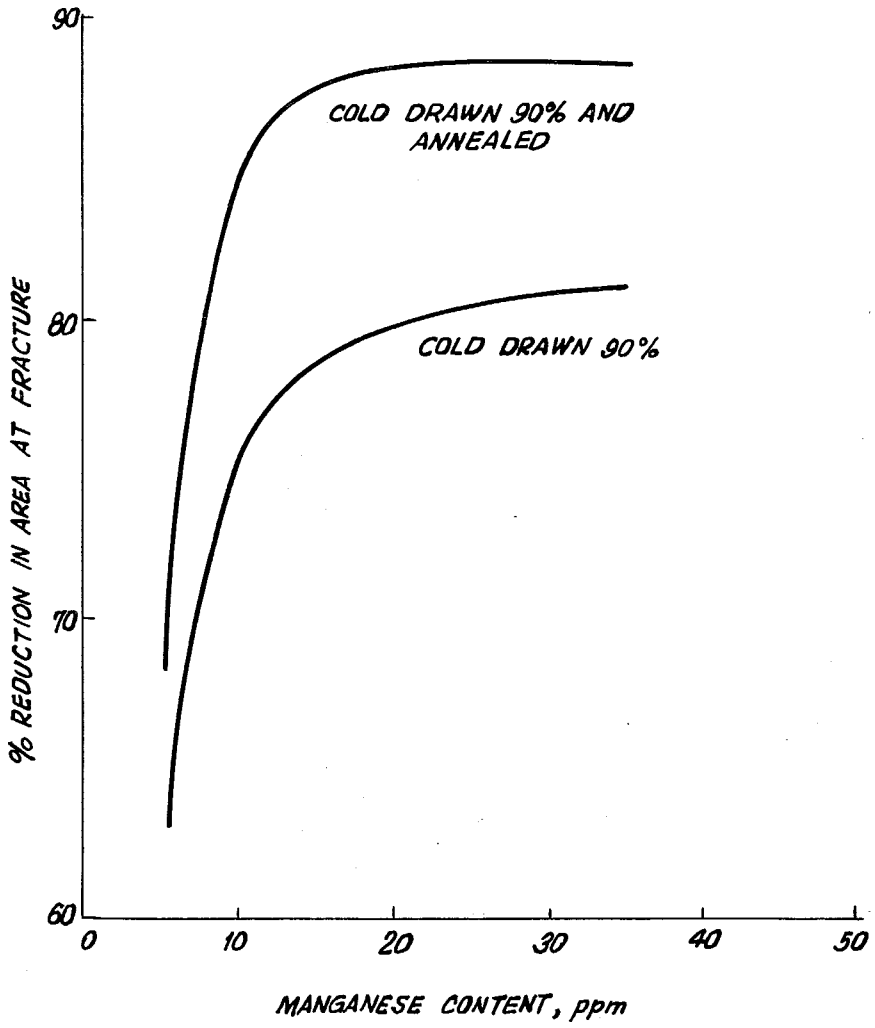

Tables 5 and 7 illustrate that the electrical conductivities of samples from the four rods exceeded 101% IACS after the rods were cold-drawn and annealed. FIGS. 6 and 7 illustrate that cold working initially reduced fracture ductilities, as measured by percent reduction in area at fracture, of the coppers. The reduction was nevertheless minimized by manganese additions. It is also apparent from FIG. 6 that with 50% cold drawing, there is a considerable drop in fracture ductility for the oxygen-free coppers containing less than 35 parts per million manganese by weight. FIG. 7 shows that at 50% cold drawing, the ductility of the oxygen-free copper containing 35 parts per million was restored to that of the as-cast condition by annealing, while those coppers of lower manganese contents experienced lower ductilities after the anneal, as indicated by the arrows. At 50% cold drawing, oxygen-free copper with approximately 30 parts per million of manganese restores in ductility to the cold-drawn condition by annealing. FIG. 8 illustrates that an increase in ductility is obtained with increased manganese contents both after 90% cold working and after subsequent annealing. It has been generally observed by the inventors that approximately 30 parts per million of manganese by weight is needed to provide sufficient ductility, for widely varying amounts of cold working.

EXAMPLE IV

Figure 9A:
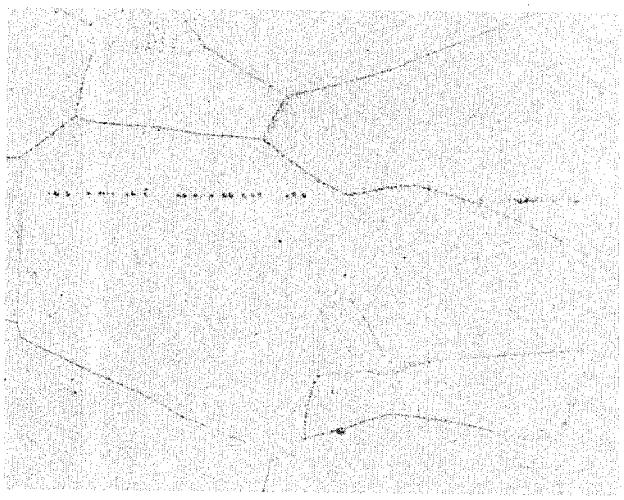
FIGS. 9(*a*), 9(*b*) and 9(*c*) are photomicrographs illustrating the effects of adding various amounts of manganese to oxygen-free coppers.
Figure 9B:
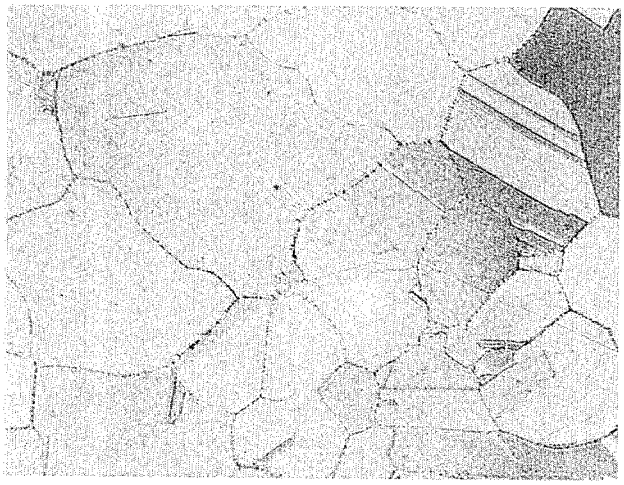
Figure 9C:
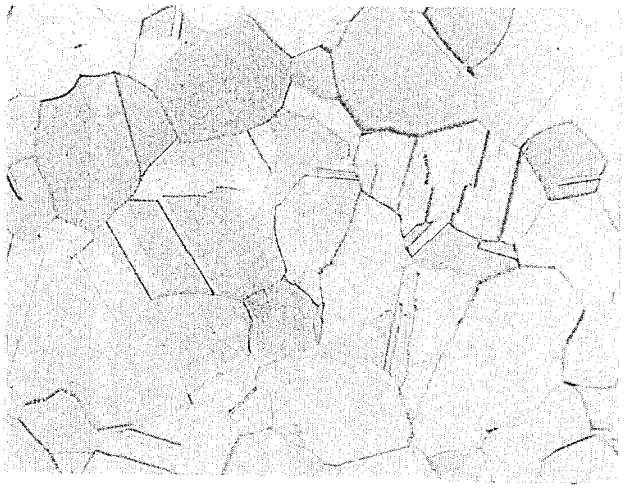

The 90% cold drawn coppers of Example III were heated at 1562° F for 30 minutes in a mixture of 85% nitrogen and 15% hydrogen atmosphere, followed by a water quench. Microscopic examinations on the longitudinal sections of the samples were made. The degree of contamination, as described in ASTM F68, was found to decrease with increasing amounts of manganese in the oxygen-free copper. FIG. 9 clearly illustrates the beneficial effect of manganese addition. It is to be noted that the photomicrographs were obtained with electrolytic etching with phosphoric acid and are shown at a magnification of 300 to accentuate contamination and segregation.

EXAMPLE V

Figure 10:
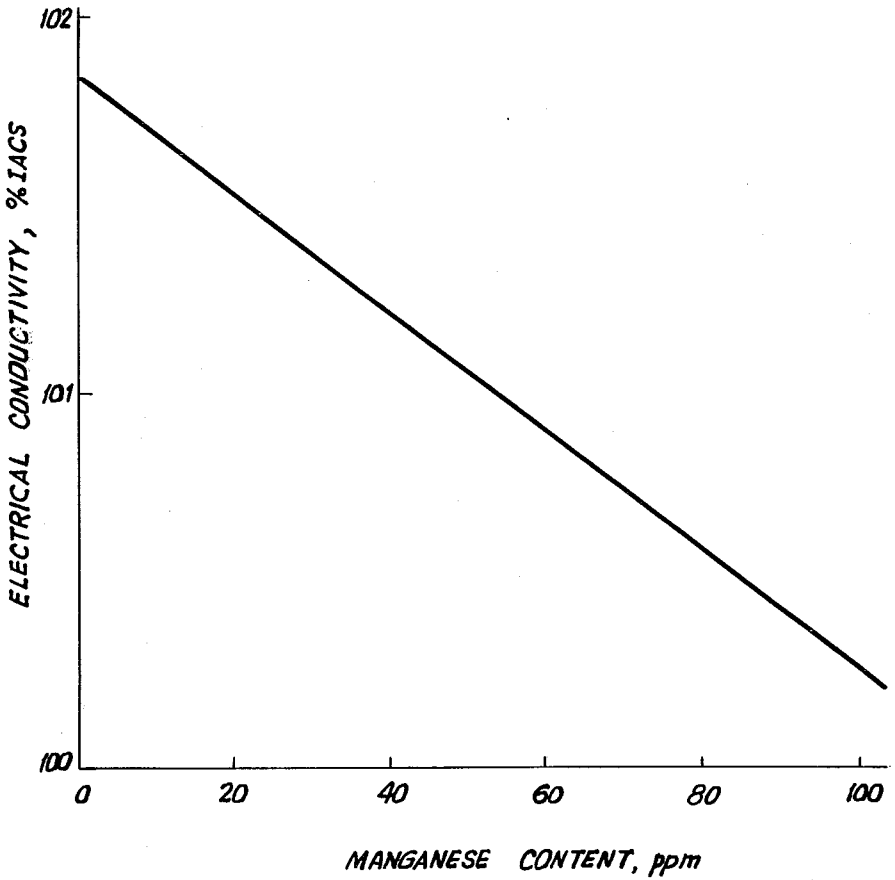
FIG. 10 illustrates the electrical conductivity of annealed oxygen-free copper with various manganese additions.

As illustrated in FIG. 10, a minimum electrical conductivity above 101% I.A.C.S. (International Annealed Copper Standard) can be obtained in the present invention while adding manganese to oxygen-free copper in amounts up to approximately 50 parts per million by weight. Also as illustrated in FIG. 10, a minimum electrical conductivity above 100% I.A.C.S. can be obtained in the present invention while adding manganese to oxygen-free copper in amounts up to approximately 100 parts per million by weight.

Copper produced according to this invention generally shows increasingly less rough or "orange peel", and consequently shinier, surfaces after annealing as the amounts of manganese additions were increased.

From the foregoing, it is apparent that the addition of manganese to oxygen-free copper imparts to the copper unique and desirable properties not hitherto known to those skilled in the art. As illustrated in the above examples, an oxygen-free copper with up to approximately 100 parts per million by weight of manganese has improved ductility, controlled grain growth behavior, a minimum electrical conductivity above 100% I.A.C.S., shinier surfaces after annealing, and is less subject to cracking. An addition of approximately 50 parts per million of manganese will provide these advantages with a minimum electrical conductivity above 101% I.A.C.S. If the manganese added is at least approximately 30 parts per million, ductility is maximized.

What is claimed is:

1. An improved oxygen-free copper product consisting essentially of non-deoxidized oxygen-free copper containing normal impurities and manganese in addition from approximately 1 to approximately 100 parts per million by weight, further characterized by having a minimum electrical conductivity of at least 100% I.A.C.S.

2. The invention defined in claim 1, wherein the manganese in addition is no more than approximately 50 parts per million by weight, and the minimum electrical conductivity is at least 101% I.A.C.S.

3. The invention defined in claim 1, wherein the manganese in addition is at least approximately 30 parts per million by weight.

4. The invention defined in claim 2, wherein the manganese in addition is at least approximately 30 parts per million by weight.

5. The invention defined in claim 1, wherein the copper product has been cold worked and annealed.

6. The invention defined in claim 2, wherein the copper product has been cold worked and annealed.

7. The invention defined in claim 5, wherein the grain size of the product is relatively homogeneous and the product has a smooth surface.

8. The invention defined in claim 6, wherein the grain size of the product is relatively homogeneous and the product has a smooth surface.

9. A process of providing an improved oxygen-free copper, wherein the copper is processed to be free from oxygen by conventional non-deoxidizing means, and manganese is added during the processing in an amount from approximately 1 to approximately 100 parts per million by weight.

10. The invention defined in claim 9, wherein the manganese added is no more than approximately 50 parts per million be weight.

11. The invention defined in claim 9, wherein the manganese added is at least approximately 30 parts per million by weight.

12. The invention defined in claim 10, wherein the manganese added is at least approximately 30 parts per million by weight.

13. The invention defined in claim 9, wherein the oxygen-free copper with added manganese is subsequently cold worked and annealed.

14. The invention defined in claim 10, wherein the oxygen-free copper with added manganese is subsequently cold worked and annealed.

15. An improved oxygen-free copper product consisting essentially of non-deoxidized oxygen-free copper containing normal impurities and manganese in addition from approximately 1 to approximately 100 parts per million by weight, further characterized by having been annealed, having a minimum electrical conductivity of at least 100% I.A.C.S., and having a controlled grain structure of relatively homogeneous grain sizes.

16. The invention defined in claim 15, wherein the manganese in addition is no more than approximately 50 parts per million by weight, and the minimum electrical conductivity is at least 101% I.A.C.S.

17. The invention defined in claim 15, wherein the manganese in addition is at least approximately 30 parts per million by weight.

18. The invention defined in claim 16, wherein the manganese in addition is at least approximately 30 parts per million by weight.

19. A process of controlling grain size during annealing in oxygen-free copper to obtain relatively homogeneous grain sizes, wherein the copper is processed to be free from oxygen by conventional non-deoxidizing means, manganese is added in an amount from approximately 1 to approximately 100 parts per million by weight, and the copper is annealed.

20. The invention defined in claim 19, wherein the manganese added is no more than approximately 50 parts per million by weight.

21. The invention defined in claim 19, wherein the manganese added is at least approximately 30 parts per million by weight.

22. The invention defined in claim 20, wherein the manganese added is at least approximately 30 parts per million by weight.

* * * * *

UNITED STATES PATENT OFFICE

CERTIFICATE OF CORRECTION

PATENT NO. : 4,059,437

DATED : November 22, 1977

INVENTOR(S) : Donald J. Nesslage, Lin S. Yu, Michael F. Shaw

It is certified that error appears in the above-identified patent and that said Letters Patent are hereby corrected as shown below:

Col. 2, line 8, "aleviated" should be --alleviated--.

Col. 3, Table 1, line 8, "Manganese <.5" should be --Manganese <1.0--.

Col. 5, Table 7, "YS(0.2% Est.)" should be --YS(0.2% Ext.)--.

Claim 10, line 3, "be" should be --by--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*